US006276964B1

(12) United States Patent
Shinozaki

(10) Patent No.: US 6,276,964 B1
(45) Date of Patent: Aug. 21, 2001

(54) JOINT CONNECTOR

(75) Inventor: Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/499,056

(22) Filed: Feb. 4, 2000

(30) Foreign Application Priority Data

Feb. 16, 1999 (JP) ..... 11-037789
Feb. 16, 1999 (JP) ..... 11-037792

(51) Int. Cl.[7] ..... H01R 13/40
(52) U.S. Cl. ..... 439/595; 439/912
(58) Field of Search ..... 439/189, 511, 439/595, 912

(56) References Cited

U.S. PATENT DOCUMENTS

| | | | | |
|---|---|---|---|---|
| 4,342,495 | * | 8/1982 | Bennett et al. | 339/163 |
| 4,448,471 | | 5/1984 | Berry et al. | 339/91 |
| 5,015,199 | | 5/1991 | Hirano et al. | 439/353 |
| 5,201,668 | * | 4/1993 | Endo et al. | 439/189 |
| 5,403,204 | | 4/1995 | Chishima et al. | 439/513 |
| 5,769,650 | | 6/1998 | Aoyama et al. | 439/189 |
| 6,068,512 | * | 5/2000 | Sugie | 439/595 |
| 6,077,117 | * | 6/2000 | Iwahori | 439/595 |

* cited by examiner

*Primary Examiner*—Tulsidas Patel
*Assistant Examiner*—T. Le
(74) *Attorney, Agent, or Firm*—Anthony J. Casella; Gerald E. Hespos; Michael J. Porco

(57) ABSTRACT

There are two engaged states of a female connector housing 20 and a joint housing 30: a partly engaged state where the housings 20 and 30 are partly engaged and a fully engaged state where they are fully engaged to connect terminals 32 and 40 thereof. Electrical conduction testing openings 25 are formed in the bottom wall of the female connector housing 20. The testing openings 25 are open when the housings 20 and 30 are partly engaged while being closed by testing opening closing portions 35 provided in the joint housing 30 when they are fully engaged. In the partly engaged state, a probe 50 is inserted through the open testing opening 25 to be electrically brought into contact with the female terminal fitting 40 in a corresponding cavity 21, thereby testing the electrical conduction of the female terminal fitting 40.

4 Claims, 12 Drawing Sheets

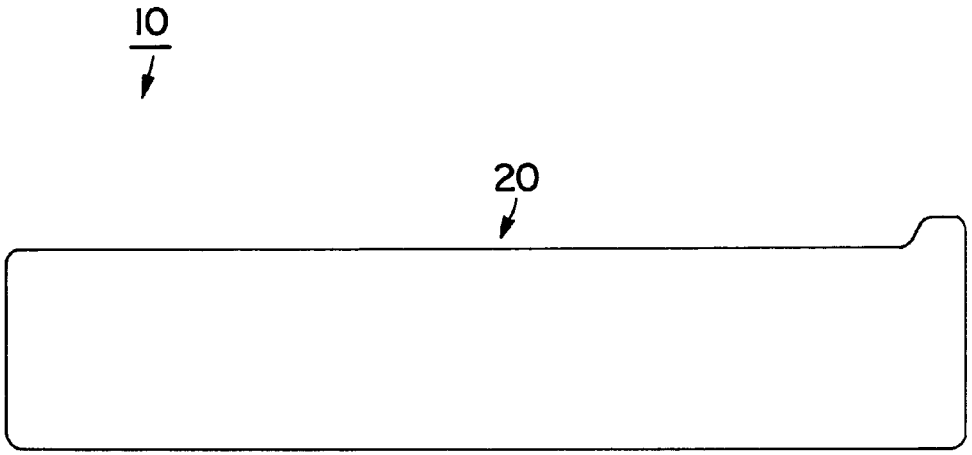
FIG. 1
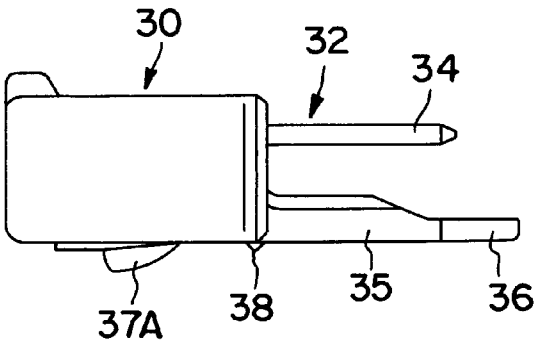

JOINT CONNECTOR

BACKGROUND OF THE INVENTION

1. Field of the Invention

The present invention relates to a joint connector.

2. Description of the Related Art

A known joint connector is disclosed in U.S. Pat. No. 5,015,199, and is identified by the numeral 1 in FIGS. 13 and 14. The prior art joint connector 1 is comprised of a joint housing 3 provided with a joint terminal 2, and a female connector housing 6 formed with a plurality of cavities 5. The prior art housings 3 and 6 are settable in a partly engaged state, as shown in FIG. 13. Female terminal fittings 4 are connected with wires, and are mounted in the selected cavities 5 of the prior art female connector housing 6 while the housings 3 and 6 are in their partly engaged state. The prior art housings 3 and 6 then can be advanced to a fully engaged state, as shown in FIG. 14 to connect the terminals 2 and 4.

Wrong terminal fittings 4 may be inserted into the cavities 5 during the assembling operation. Thus an electrical conduction test is performed to determine whether the correct female terminal fittings 4 have been inserted into the respective cavities 5. A conduction test typically requires a testing probe to be brought into contact with the female terminal fitting 4. This may be achieved by inserting the test probe through an opening at the side of the female connector housing 6 that has been engaged with the joint housing 3. Thus, this cumbersome test requires the housings 3 and 6 to be disengaged and then engaged again after the test is completed.

Furthermore, the female terminal fittings 4 are selectively mounted in the respective cavities 6 according to how they are used. However incorrect female terminal fittings 4 may inadvertently be mounted in the cavities 6 during the assembly of the joint connector 1. If such a situation is found before the housings 3 and 5 are fully engaged, it is necessary to withdraw the female terminal fittings 4 that were inserted erroneously, and then to insert the proper female terminal fitting 4. This requires the housings 3 and 5 of the above described prior art joint connector 1 to be disengaged to expose the front surface of the female connector housing 5. A disengaging jig then is inserted through an opening exposed at the front surface of the female connector housing 5. The disengaging jig is manipulated to deform the locking portion 7 elastically in a departing direction, and the female terminal fitting 4 is withdrawn while the locking portion 7 is disengaged. The proper female terminal fittings 4 then are inserted, and the housings 3 and 5 are engaged again. The above described prior art joint connector 1 necessitates such a cumbersome operation.

In view of the above problem, an object of the present invention is to provide a joint connector having an excellent assembling operability.

SUMMARY OF THE INVENTION

The subject invention is directed to a joint connector. The joint connector comprises a connector housing which has a plurality of cavities formed therein. Terminal fittings are provided, and can be inserted at least partly into the respective cavities of the connector housing.

The joint connector further comprises a joint housing that can be engaged with the connector housing. A joint fitting is mounted to the joint housing and is configured for mating with and shorting a plurality of the terminal fittings when the housings are fully engaged.

Insertion openings are formed in an outer wall of the connector housing, and are aligned substantially with the respective cavities of the connector housings. The insertion openings may be disposed and configured to enable the electrical contact of an electrical conducting testing jig to engage the terminal fitting when the electrical conduction testing jig is inserted from outside the outer wall and when the two housings are at least partly engaged. Then, the electrical conduction test can be conducted for the terminal fittings by using the insertion openings provided in the outer wall of the connector housing.

Operability is improved with this embodiment of the subject invention because an electrical conduction test for the female terminal fittings can be conducted while the two housings are partly engaged. Thus, an electrical conduction test can be conducted without disengaging two housings.

Each cavity of the connector housing may be formed with an elastic locking piece for elastically engaging the corresponding terminal fitting and locking the terminal fitting in the cavity.

The insertion openings may be formed in an outer wall of the connector housing in proximity to the elastic locking pieces. Additionally, the insertion openings may be configured to accommodate a jig for disengaging the elastic locking piece from the terminal fitting while the housings are engaged at least partly.

Accordingly, the terminal fitting can be withdrawn by inserting the disengaging jig through the corresponding insertion opening and disengaging the elastic locking piece while the housings are engaged. Thus, operability can be improved.

The housings preferably can be set in a partly engaged state and in a fully engaged state. The terminal fittings and the joint terminal are connected to one another when the housings are in the fully engaged state. The joint housing also is formed with a closing portion for leaving the insertion openings open when the two housings are in the partly engaged state, and for closing the insertion openings when the two housings are in the fully engaged state. Accordingly, operability is satisfactory because the insertion openings are closed by the closing portion if the housings are moved from the partly engaged state to the fully engaged state.

The closing portion preferably is provided with a deformation-restricting portion which can be inserted into a space that would otherwise permit the elastic deformation of the elastic locking pieces. Thus the deformation-restricting portion restricts the elastic deformation of the elastic locking pieces. Accordingly, the female terminal fittings can be locked securely since the elastic deformation of the elastic locking pieces is restricted.

A jig may be provided for checking the electrical conduction of the terminal fittings that are accommodated in the cavities. The jig may be inserted through the insertion openings, and may be brought into electrical contact with the terminal fittings. Then, the electrical conduction test can be conducted for the terminal fittings.

According to the invention, the insertion openings may function as either or both electrical conduction testing openings and/or as disengaging openings for allowing the insertion of a disengaging jig for disengaging the female terminal fittings from the elastic locking pieces.

The joint housing also may have insufficient insertion detecting means for detecting the insufficient insertion of the terminal fittings into the respective cavities. Insufficient insertion may be detected by an engagement of the joint housing with the elastic locking piece that is deflected by the insufficiently inserted terminal fittings.

These and other objects, features and advantages of the present invention will become more apparent upon a reading of the following detailed description and accompanying drawings.

BRIEF DESCRIPTION OF THE DRAWINGS

FIG. 1 is a side view of a joint connector according to one embodiment.

DETAILED DESCRIPTION OF THE PREFERRED EMBODIMENT

Figure 2:
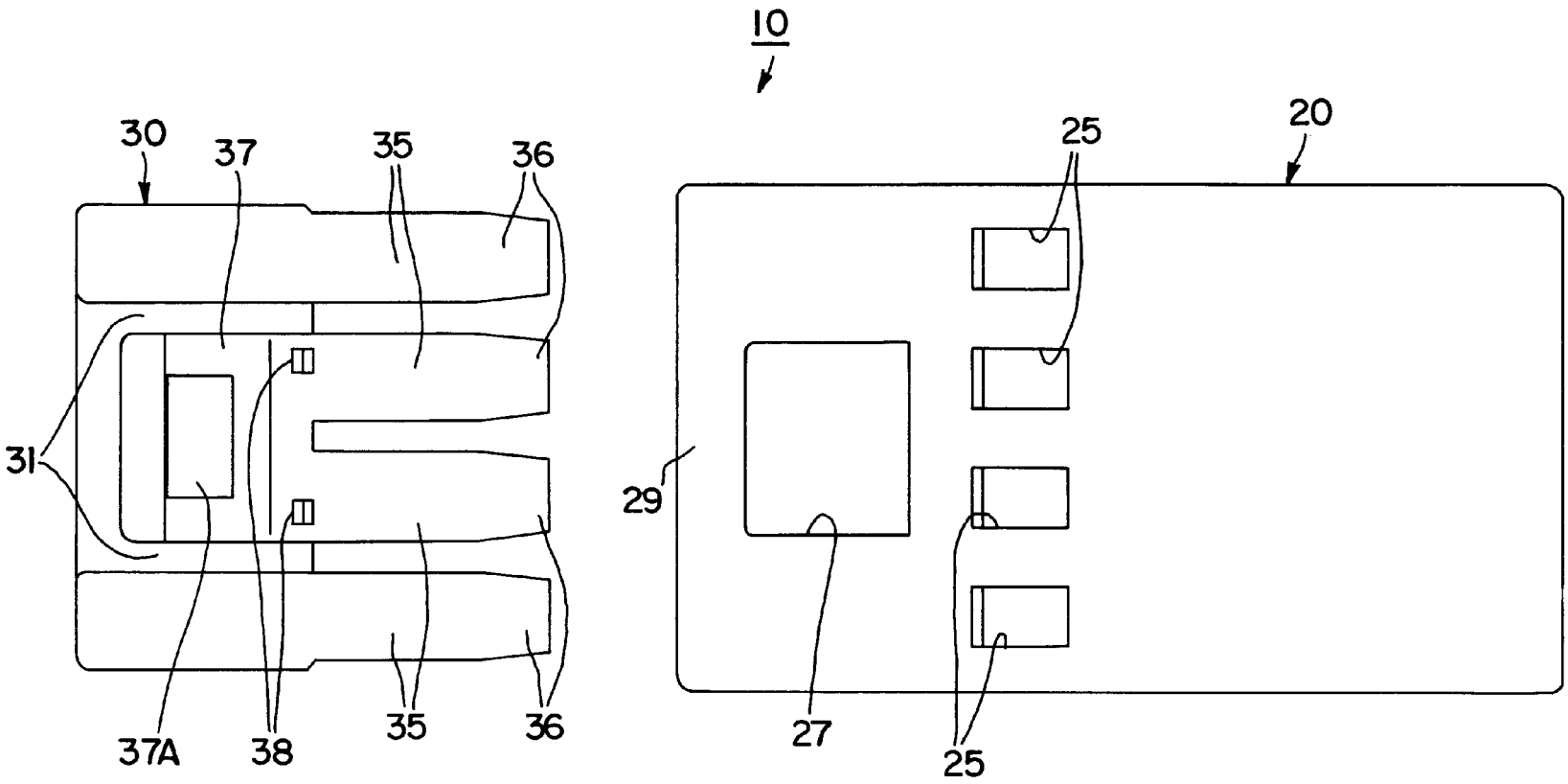
FIG. 2 is a bottom view of the joint connector.

A joint connector according to a first embodiment of the invention is identified generally by the numeral 10 in FIGS. 1–10. The joint connector 10 is provided with a female connector housing 20 for accommodating a plurality of female terminal fittings 40. The joint connector 10 also has a joint housing 30 with a joint terminal 32 that can be connected with the respective female terminal fittings 40. The housings 20 and 30 are at least partly engageable with each other. In the description below, the sides of the housings 20 and 30 that are to be engaged with each other are referred to as front sides.

Figure 3:
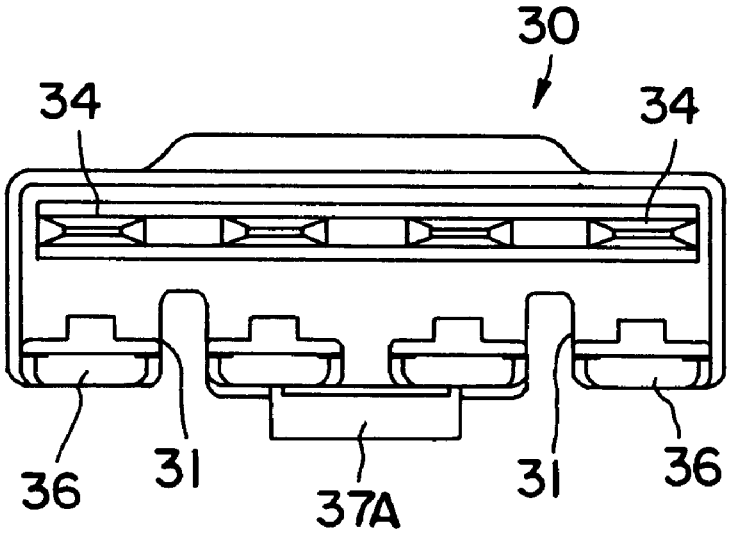
FIG. 3 is a front view of a joint housing.
Figure 4:
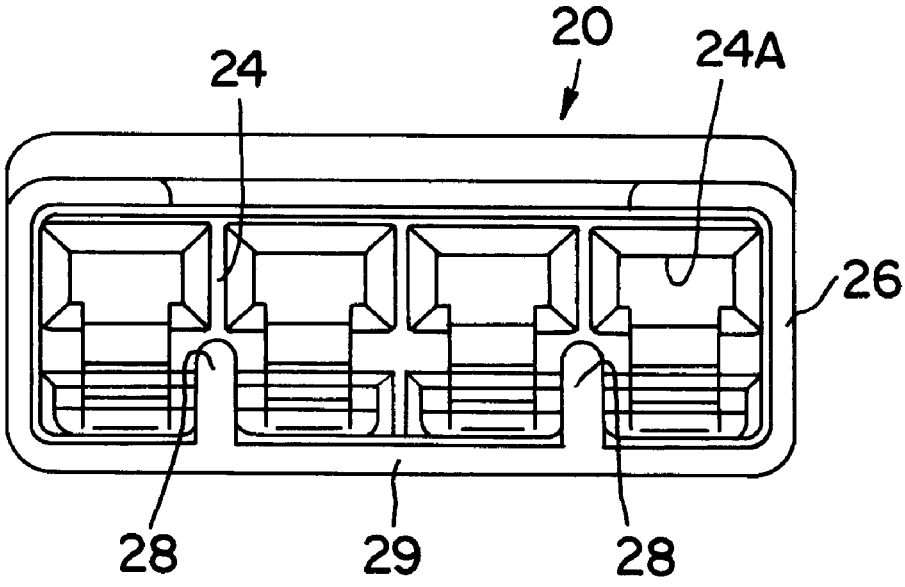
FIG. 4 is a front view of a female connector housing.
Figure 5:
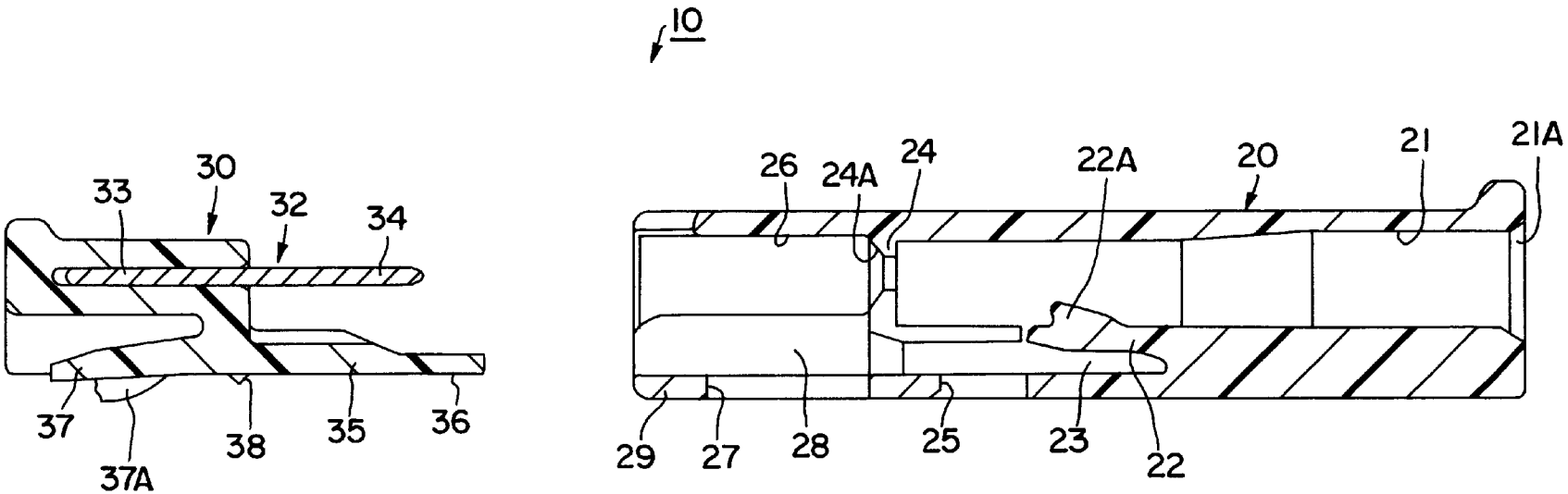
FIG. 5 is a side view in section of the joint connector.
Figure 6:
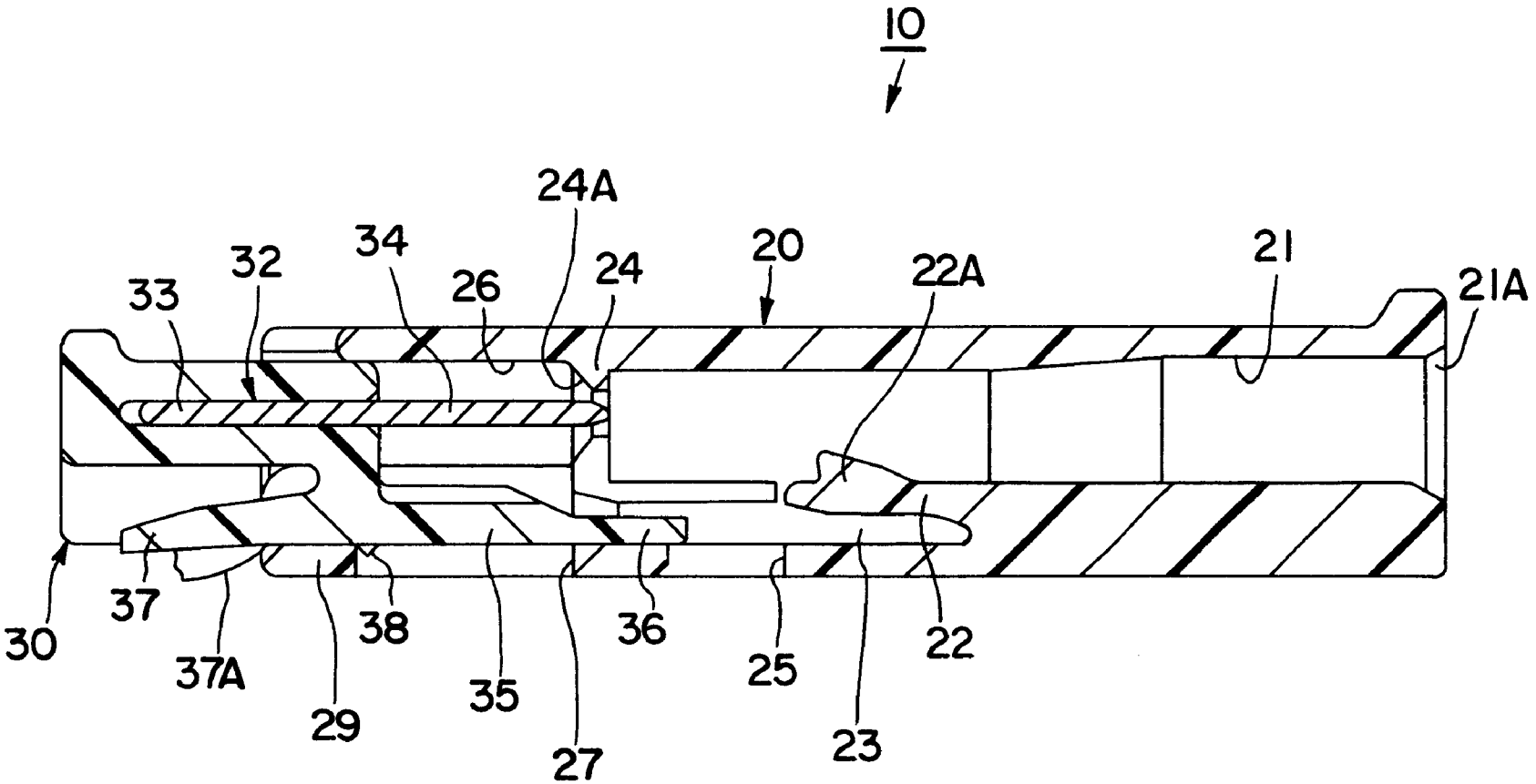
FIG. 6 is a side view in section of the joint connector in its partly engaged state.

The female connector housing 20 is formed, for example, of a synthetic resin material, and has a substantially box-shape which is substantially open in its front and rear surfaces, as shown in FIGS. 3 to 5. The inside of the female connector housing 20 is partitioned into front and rear sections by a partition wall 24. Four cavities 21 are arranged side by side behind the partition wall 24 for at least partly accommodating the respective female terminal fittings 40. The female terminal fittings 40 can be inserted at least partly into the respective cavities 21 through terminal insertion openings 21 A formed at the rear side. Tab insertion openings 24A are formed at the front side of the cavities 21 and penetrate through the partition wall 24. Tabs 34 of the joint terminal 32 can be inserted into the cavities 21 through the respective tab insertion openings 24A, as described further below.

A locking portion 22 cantilevers forwardly from the middle of the bottom wall of each cavity 21. The locking portion 22 is formed integrally with the female connector housing 20, and is elastically deformable into a deformation permitting space 23 defined below the cavity 21. A locking projection 22A is formed at the leading end of the locking portion 22, and can be projected into the corresponding cavity 21. In this manner, the locking projection 22A can be engaged with the female terminal fitting 40 to substantially lock the female terminal fitting 40 in position.

Electrical conduction testing openings or jig insertion openings 25 (testing openings) are formed in the bottom wall of the female connector housing 20 and communicate with the front parts of the deformation permitting spaces 23 below the corresponding cavities 21. Each opening 25 preferably is substantially rectangular and is dimensioned to permit the insertion of a probe 50 for the electrical connection test to be described later. The testing openings 25 also serve as disengaging openings to permit the insertion of a disengaging jig 51 for disengaging the locking portion 22 from the female terminal fitting 40.

A tubular receptacle 26 is provided in front of the partition wall 24, and the joint housing 30 can be fitted at least partly into the tubular receptacle 26. A pair of transversely spaced and longitudinally extending guide pieces 28 project from the bottom surface of the receptacle 26. The guide pieces 28 can be fitted into guide grooves 31 (see FIG. 3) formed in the joint housing 30. Thus the joint housing 30 can be guided smoothly into the receptacle 26 and the upside-down engagement of the housings 20 and 30 can be prevented. A substantially rectangular locking hole 27 is formed in the bottom wall of the receptacle 26, and a portion between the front edge of the locking hole 27 and the front edge of this bottom wall serves as a locking portion 29. A full-lock projection 37A and partial-lock projections 38 are provided in the joint housing 30 for engagement with the locking hole 27 and the locking portion 29 as described later.

Figure 7:
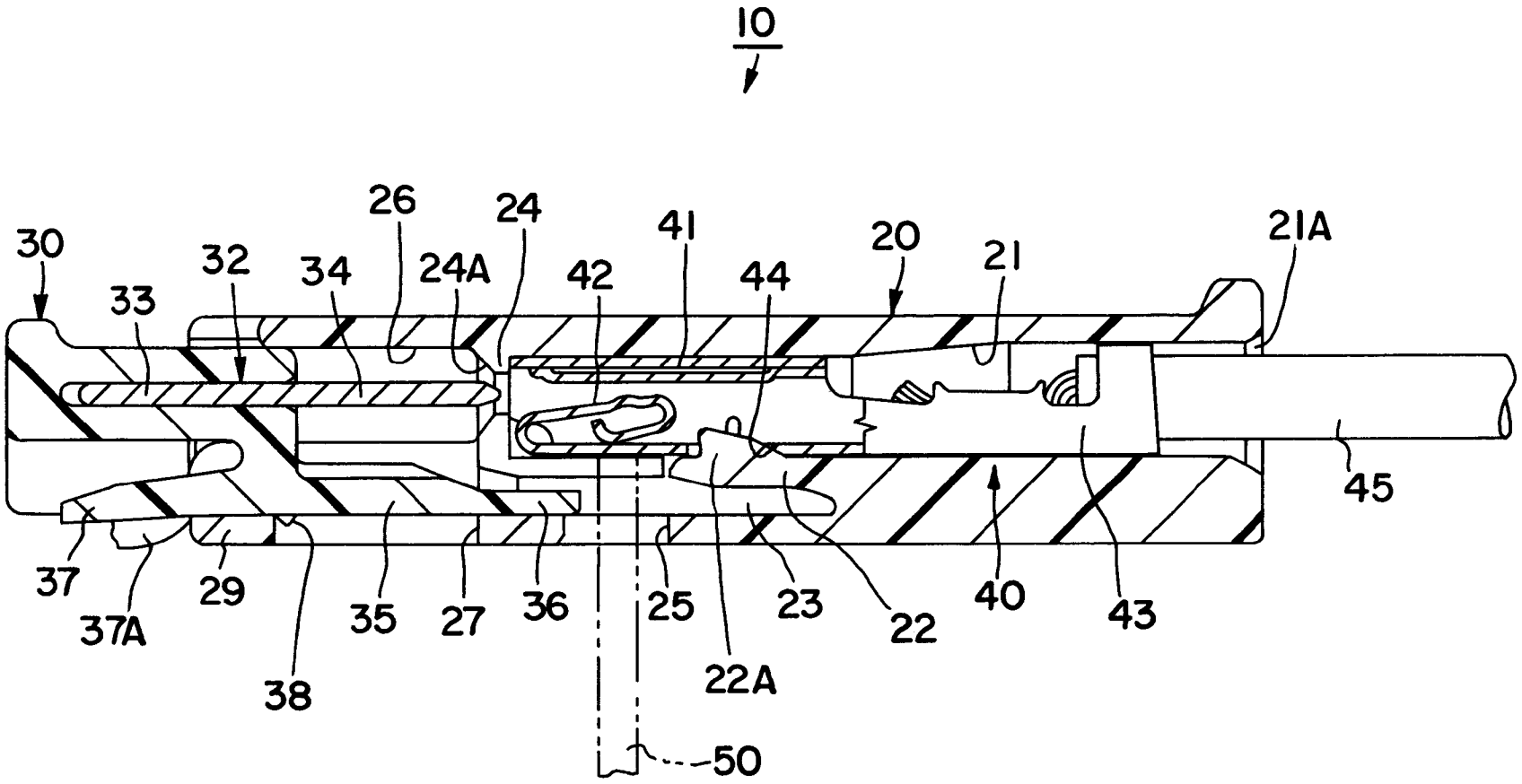
FIG. 7 is a side view in section of the joint connector having female terminal fittings mounted therein.
Figure 8:
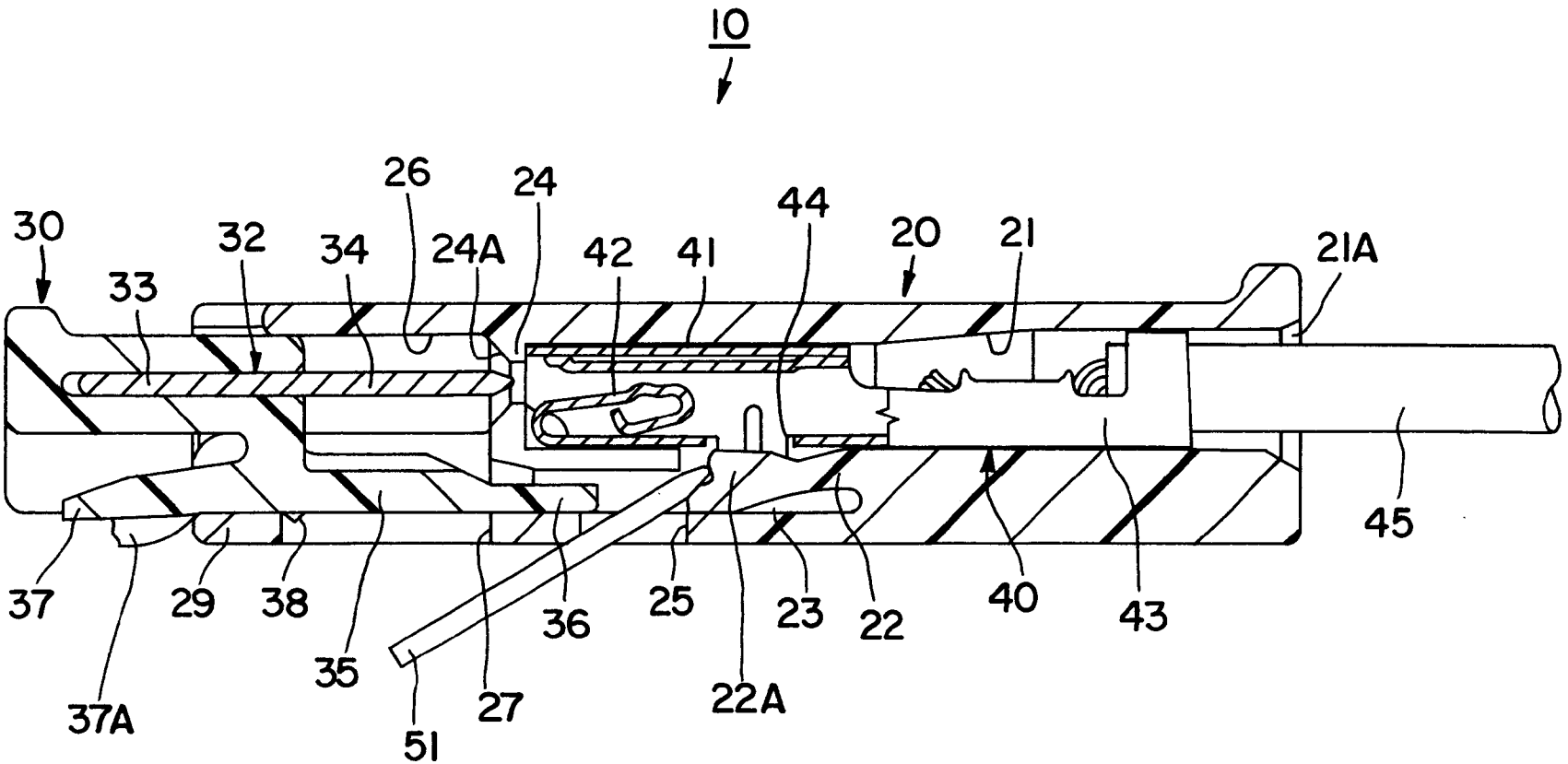
FIG. 8 is a side view in section showing how a locking portion is disengaged.

Each female terminal 40 of the female connector housing 20 is formed, for example, by bending a conductive metal plate member (see FIG. 7). A connection portion 41 is formed at the front side of the female terminal fitting 40. The connection portion 41 is in the form of a substantially rectangular tube that is connectable with a tab 34 to be described later. A substantially elastic contact piece 42 is provided in the connection portion 41, and can be brought elastically into contact with the tab 34. The connection portion 41 also has an engaging hole 44 formed in its bottom wall. The engaging hole 44 can be engaged by the locking projecting 22A of the locking portion 22. A barrel portion 43 is provided at the rear end of the connection portion 41 and can be connected mechanically and electrically to an end of a wire 45.

The joint housing 30 is formed, for example, of a synthetic resin material, and has a substantially box-shape with an outer configuration that is slightly smaller than the inner configuration of the receptacle 26. The bottom surface of the joint housing 30 is formed with a pair of transversely spaced guide grooves 31. Thus the entire joint housing 30 can be guided into the receptacle 26 by fitting the guide pieces 28 in the guide grooves 31 as described above.

A locking piece 37 is formed integrally or unitarily with the bottom wall of the joint housing 30, and preferably is cantilevered in a backward direction. The locking piece 37 is elastically deformable upwardly and downwardly or toward and away from the joint housing 30, and the locking projection 37A projects downwardly from the locking piece 37. A pair of small wedge-shaped projections 38 project downwardly from locations near the base of the locking piece 37. There are two engaged states of the housings 20 and 30, namely, a partly engaged state (see FIG. 6) where the joint housing 30 is fitted partly into the receptacle 26 and a substantially fully engaged state (see FIG. 9) where it is substantially fully fitted into the receptacle 26. The locking portion 29 is engaged between the locking projection 37A and the projections 38 in the partly engaged state. In the fully engaged state, the front surface of the joint housing 30 substantially abuts against the partition wall 24, and the locking projection 38 is fitted in the locking hole 27.

The joint terminal 32 preferably is made of a conductive metal plate member, and, in this embodiment, has four tabs 34 that project substantially in alignment with one another from a base portion 33. The base portion 33 can be pressed into the joint housing 30, such that tabs 34 project toward the female connector housing 20. When the housings 20 and 30 are partly engaged, the respective tabs 34 preferably do not project into the cavities 21 and therefore are not in contact with the female terminal fittings 40 in the cavities 21. However, when the housings 20 and 30 are fully engaged, the respective tabs 34 extend into the cavities 21 through the tab insertion openings 24A. Thus, the respective female terminal fittings 40 in the cavities 21 are shorted to each other by connection to the tabs 34 of the joint terminal 32.

Four closing portions 35 project toward the female connector housing 20 from the bottom surface of the joint housing 30 at locations that correspond to the positions of the testing openings 25. The closing portions 35 are dimensioned to leave the testing openings 25 substantially open in the partly engaged state of the housings 20 and 30, and to substantially close the testing openings 25 in the fully engaged state of the housings 20 and 30. The leading end of each closing portion 35 serves as a deformation restricting portion 36, and is located before the locking portion 22 in the partly engaged state of the housings 20 and 30. However, the closing portion 35 is located in the deformation permitting space 23 for the corresponding locking portion 22 in the fully engaged state to substantially restrict the elastic deformation of the locking portion 22.

The joint connector 10 of this embodiment is assembled by initially fitting the joint housing 30 partly into the receptacle 26 of the female connector housing 20. The partial lock projections 38 then contact the locking portion 29, and slightly elastically deform the locking portion 29 outwardly. The joint housing 30 then can be inserted further into the receptacle 26. When the partial-lock projections 38 reach the edge of the locking hole 27, the locking portion 29 is restored substantially to its original shape and is engaged between the partial-lock projections 38 and the full-lock projection 37A. As a result, the housings 20 and 30 are held partly engaged (see FIG. 6). At this time, the testing openings 25 still are left open.

The joint connector 10 is transported to a specified site of operation with the housings 20 and 30 partly engaged into a single unit. As a result, operability is better than cases where the housings 20 and 30 are transported separately. In the partly engaged state, the joint terminal 32 that projects from the joint connector 30 is accommodated in the receptacle 26 and, therefore, is not exposed to the outside. Consequently, the joint terminal 32 is protected from deformation and damage.

Next, the female terminal fitting 40 is inserted into the specified cavity 21. After sufficient insertion, the locking projection 22A of the locking portion 22 contacts the bottom surface of the connection portion 41, and the locking portion 22 deforms elastically to project toward the deformation permitting space 23 located below. When the female terminal fitting 40 is pushed to its proper insertion position, the locking portion 22 is restored to its original shape and the locking projection 22A is fitted in the engaging hole 44. Thus, the female terminal fitting 40 is locked in the cavity 21, as shown in FIG. 7.

An electrical conduction test can be conducted next to check whether the female terminal fittings 40 have been inserted into the proper respective cavities 21 (see FIG. 7). The electrical conduction test employs a bar-shaped probe 50 made of a conductive metal material. The leading end of the probe 50 is biased constantly in a projecting direction by an unillustrated spring. The female terminal fitting 40 and the probe 50 can be connected electrically by elastically pressing the leading end of the probe 50 against the wall surface of the female terminal fitting 40. The probe 50 is connected with an unillustrated electrical conduction testing circuit to detect an electrical conductive state between the female terminal fitting 40 in the cavity 21 and a terminal fitting, an electrical device or the like which may be connected with the end of the wire 45 opposite the end connected with the female terminal fitting 40.

As described above, testing openings 25 are formed in the bottom wall of the female connector housing 20, and communicate with the spaces below the cavities 21 from the outside. The testing openings 25 are left open when the housings 20 and 30 are partly engaged with each other. The probe 50 then is inserted vertically into each testing opening 25 from outside the female connector housing 20, and enters the space below the corresponding cavity 21 to be pressed against the bottom surface of the female terminal fitting 40. In this way, the probe 50 and the female terminal fitting 40 are brought electrically into contact with each other, and the electrical conductive state thereof is detected by the electrical conduction testing circuit.

If the electrical conduction tests show that the wrong female terminal fitting 40 has been inserted into the cavity 21, then this female terminal fitting 40 is withdrawn.

The female terminal fitting 40 can be withdrawn by employing a bar-shaped disengaging jig 51 to disengage the locking portion 22. The disengaging jig 51 can be inserted obliquely into the female connector housing 20 through the insertion or testing opening 25, which also serves as a disengaging opening or jig insertion opening.

In this manner, the disengaging jig 51 catches the leading end of the locking portion 22 and pushes the locking portion 22 down or away from the terminal fitting 40. The female terminal fitting 40 then can be withdrawn from the cavity 21 after the locking projection 22A is disengaged from the engaging hole 44.

After the withdrawal of the wrong female terminal fitting 40, a proper one is inserted into this cavity 21.

Figure 9:
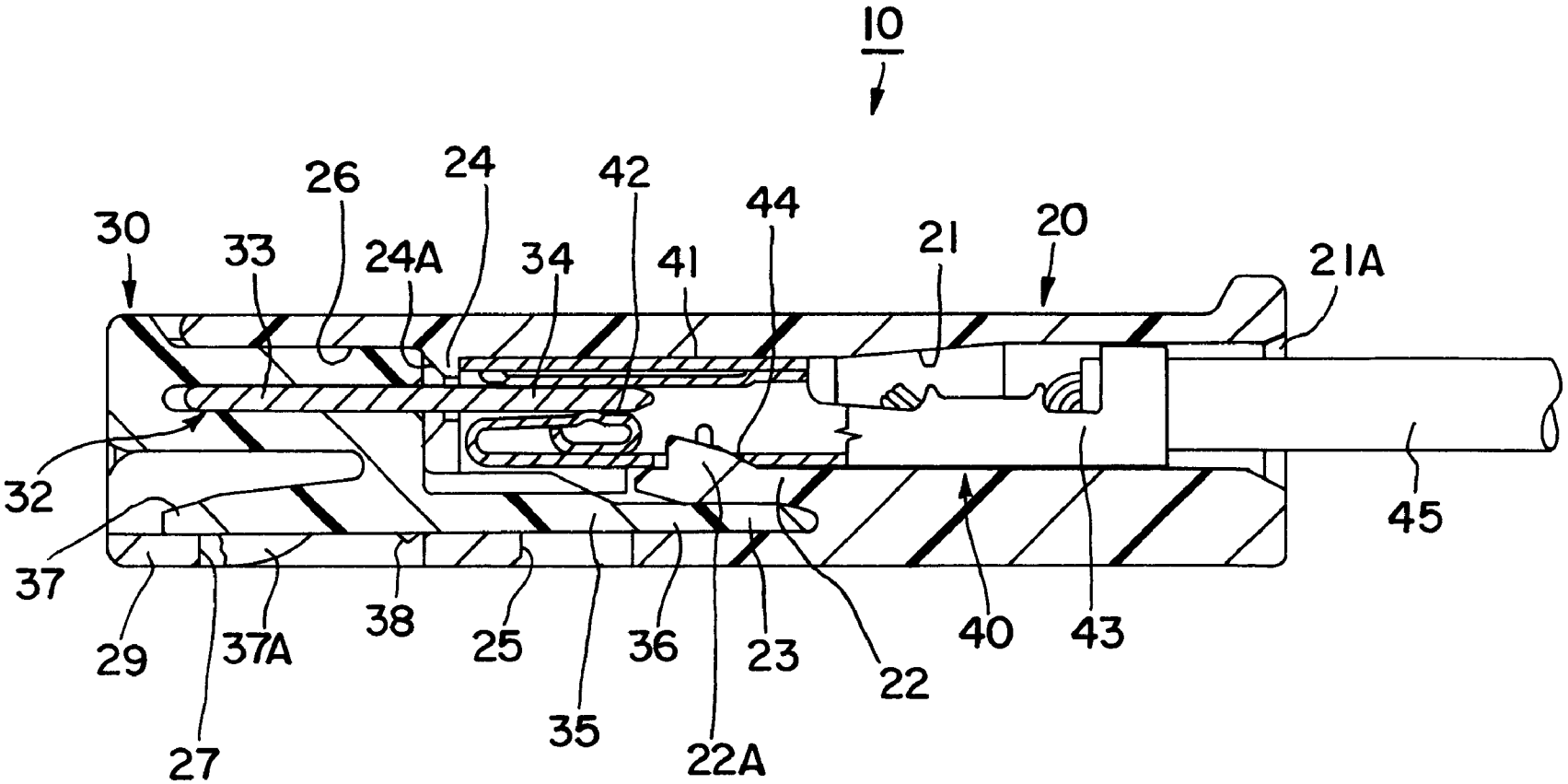
FIG. 9 is a side view in section of the joint connector in its fully engaged state.

After confirming that the female terminal fittings 40 have been inserted into the proper cavities 21, the joint housing 30 is pushed beyond its partly engaged state and toward the female connector housing 20. Continued movement of the joint housing 30 into the female connector housing 20 pushes the full-lock projection 37A further into the receptacle 26 than the locking portion 29, and hence the locking piece 37 is deformed elastically upwardly. The joint housing 30 continues to be pushed until the full-lock projection 37A reaches the locking hole 27. The locking piece 37 then is restored substantially to its original shape and the full-lock projection 37A slips into engagement with the locking hole 27. As a result, the housings 20 and 30 are held fully engaged, as shown in FIG. 9. At this time, the tabs 34 are coupled to the connection portions 41, and connect the terminal fittings 32 and 40. Thus the respective female terminal fittings 40 are shorted to each other via the joint terminal 32. While the joint housing 30 is being pushed, the closing portions 35 move to close the testing openings 25 and the deformation restricting portions 36 enter the deformation permitting spaces 23 to restrict the deformation of the locking portions 22.

Figure 10:
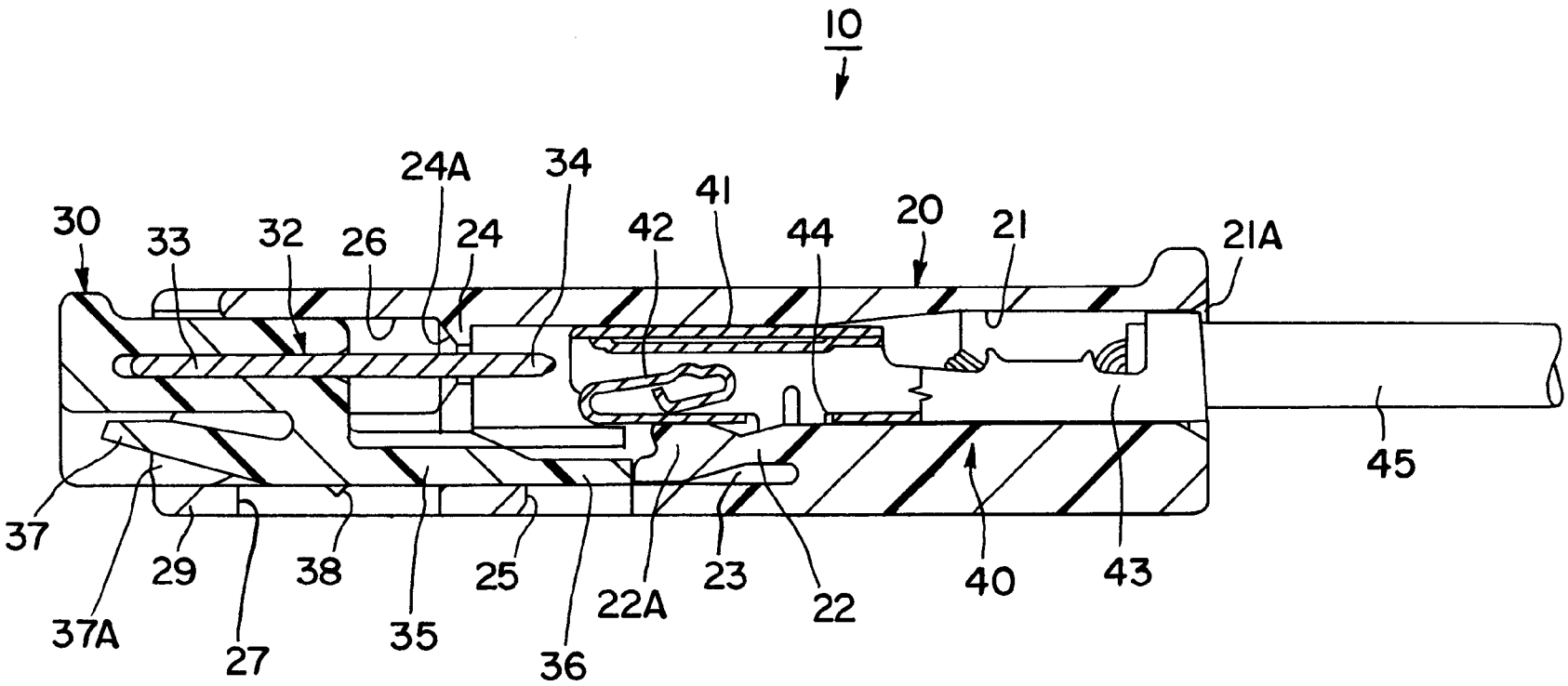
FIG. 10 is a side view in section showing how insufficient insertion is detected.

An attempt to move the housings 20 and 30 from the partly engaged state to the fully engaged state may not be successful. In particular, the joint housing 30 cannot be fitted fully into the female connector housing 20 if the female terminal fitting 40 is insufficiently inserted. This is because the leading end of the deformation restricting portion 36 contacts the locking portion 22 which, as shown in FIG. 10, is still located in the deformation permitting space 23. After detecting the insufficient insertion of the female terminal fitting 40 in this way, the female terminal fitting 40 is pushed to its proper insertion position and the joint housing 30 is pushed into the receptacle 26 again.

The insufficient insertion of the female terminal fitting 40 can be confirmed by looking into the cavity 21 through the testing opening 25.

As described above, operability is improved according to this embodiment since the electrical conduction test can be conducted for the female terminal fittings 40 even if the housings 20 and 30 are partly engaged.

Further, operability is satisfactory since the testing openings 25 are closed at the same time housings 20 and 30 are moved from the partly engaged state to the fully engaged state.

Furthermore, the female terminal fittings 40 can be locked securely since the elastic deformation of the locking portions 22 is restricted by the deformation restricting portions 36 as the housings 20 and 30 are fully engaged. Since the deformation restricting portions 36 are parts of the closing portions 35, construction can be simplified.

Further, since the testing openings 25 also serve as the disengaging openings, the locking portions 22 can be disengaged using the testing openings 25 or the electrical conduction test can be conducted for the female terminal fittings 40 using the jig insertion openings 25.

The present invention is not limited to the foregoing embodiments. For example, embodiments as described below are also embraced by the technical scope of the present invention as defined in the claims. Besides the following embodiments, a variety of changes can be made without departing from the scope and spirit of the present invention as defined in the claims.

Although the four cavities 21 are formed substantially side by side in the female connector housing 20 in the foregoing embodiment, the number thereof is not limited to 4, but may be 3 or less or 5 or more. Further, the cavities may be formed in two stages and the jig insertion openings may be formed in the top and bottom walls of the female connector housing.

Although the testing openings 25 are provided below the cavities 41 in the foregoing embodiment, they may be formed above or at the side of the cavities 21.

Figure 11:
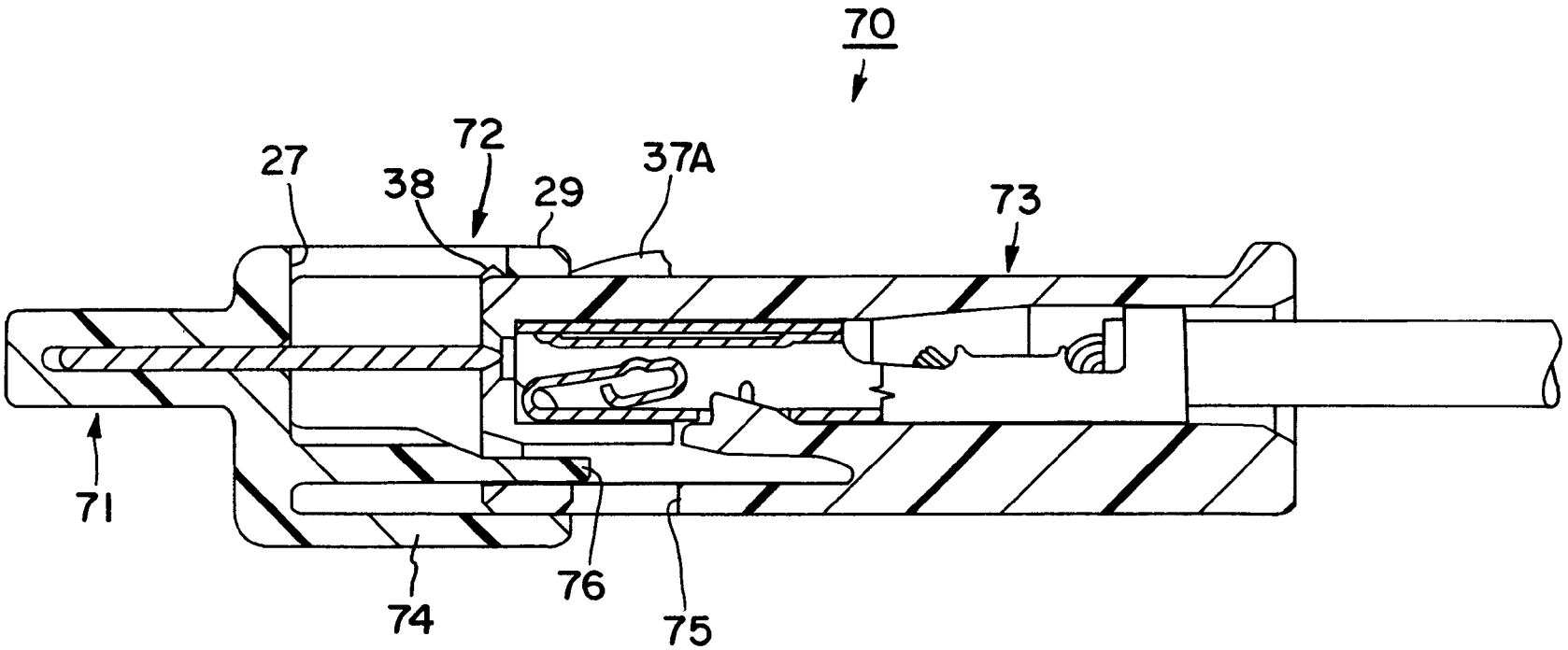
FIG. 11 is a side view in section of a joint connector according to another embodiment in its partly engaged state.
Figure 12:
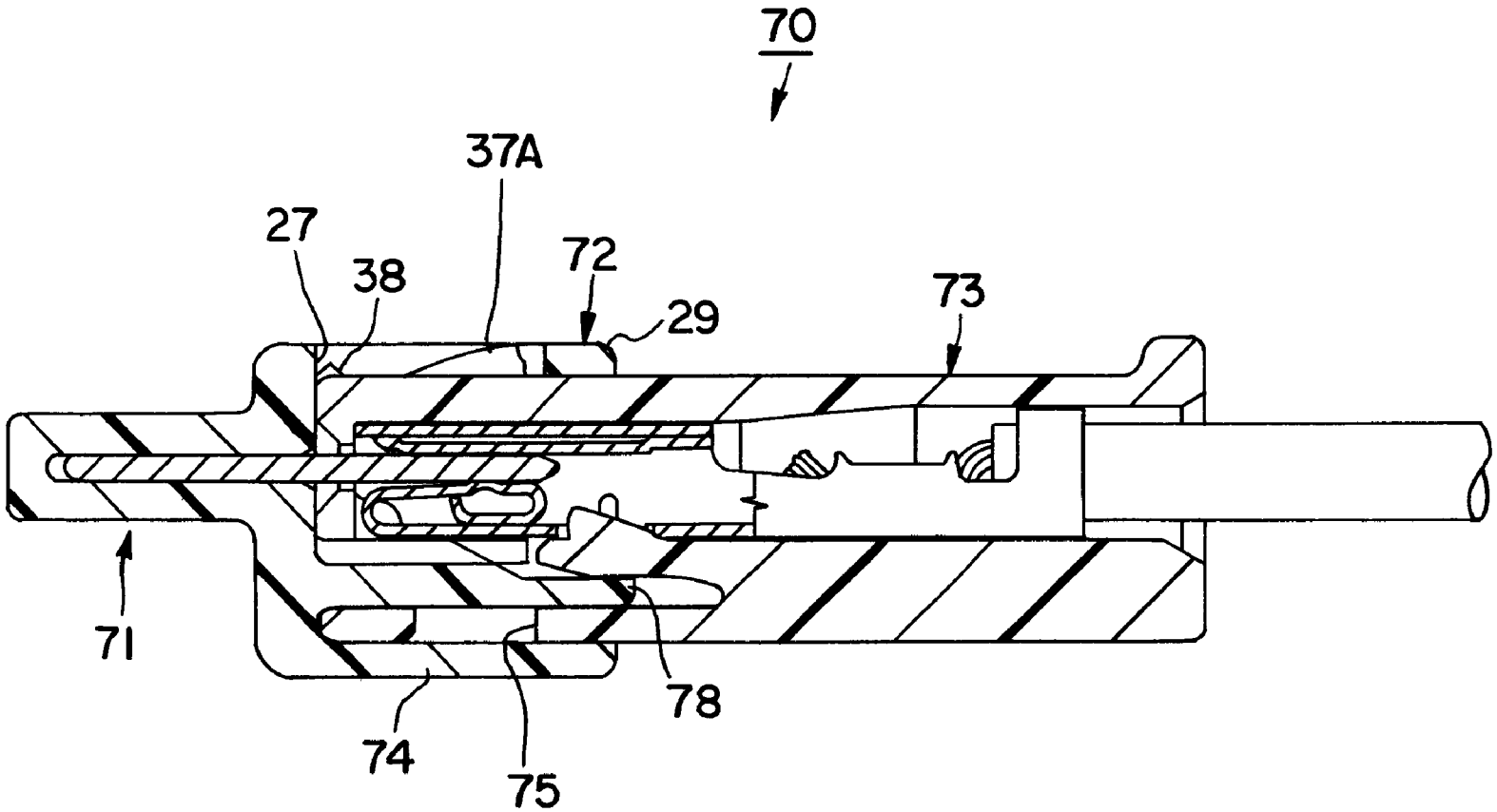
FIG. 12 is a side view of the joint connector of FIG. 11 in its fully engaged state.
Figure 13:
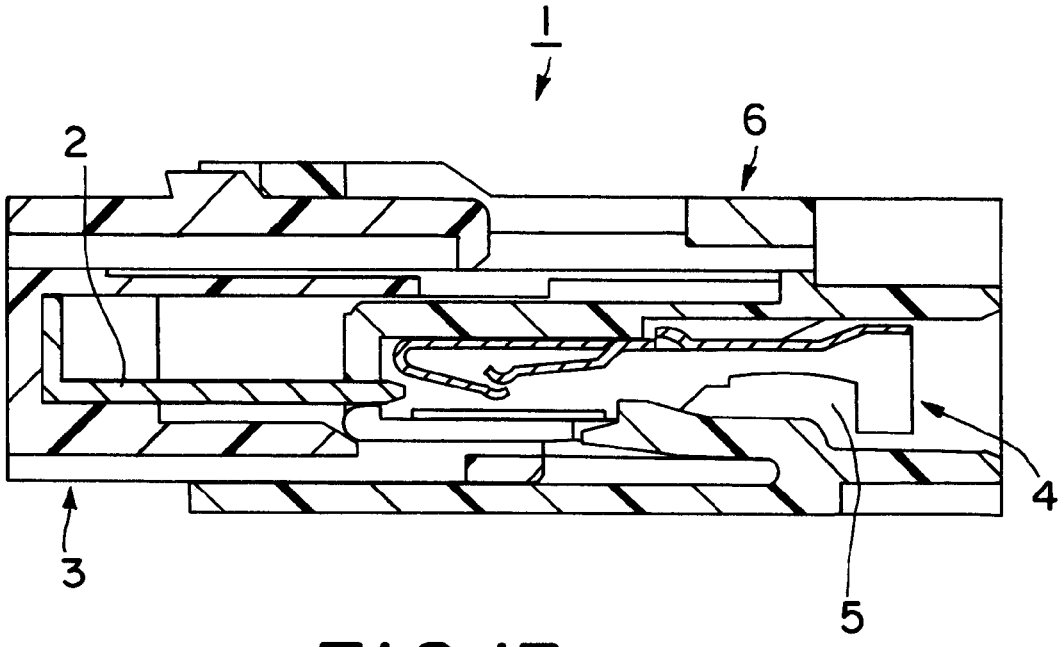
FIG. 13 PRIOR ART
FIG. 13 is a side view in section of a prior art joint connector in its partly engaged state.
Figure 14:
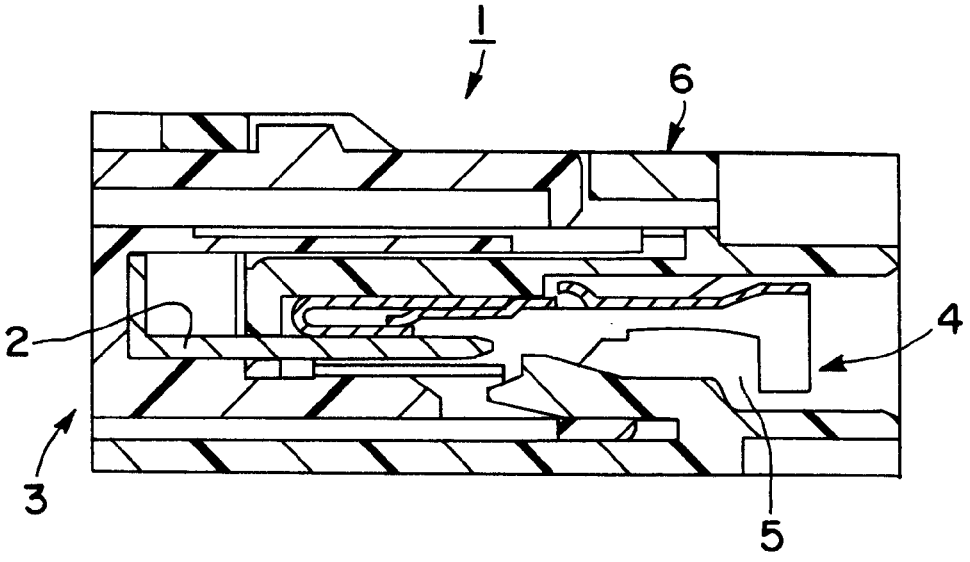
FIG. 14 PRIOR ART
FIG. 14 is a side view in section of the prior art joint connector in its fully engaged state.

Although the four closing portions 35 individually close the testing openings 25 in the foregoing embodiment, the testing openings 25 may be closed together from the outside of the female connector housing. For example, a joint connector 70 shown in FIGS. 11 and 12 has a joint housing 71 provided with a hood-shaped receptacle 72, and a female connector housing 73 is at least partly fitted into the receptacle 72. The locking hole 27 and the locking portion 29 are provided in the upper wall of the receptacle 72, whereas the full-lock projection 37A and the partial-lock projections 38 are provided on the upper surface of the female connector housing 73. The housings 71 and 73 are held partly engaged and fully engaged substantially in the same manner as in the foregoing embodiment by the elements 27, 29, 37A and 38. In this construction, the bottom wall of the receptacle 72 serves as a testing opening closing portion 74. Testing openings 75 are substantially closed together from the outside of the female connector housing 73 by fully engaging the housings 71 and 73. Further, a deformation restricting portion 76 and the closing portion 74 may be separately provided as in this embodiment.

In this embodiment, the bottom wall of the receptacle 72 serves as an insertion opening closing portion 74. Jig insertion openings 75 are closed together from the outside of the female connector housing 73 by fully engaging the housings 71 and 73. Further, a deformation restricting portion 76 and the closing portion 74 may be separately provided as in this embodiment.

In this embodiment, the projections 38 and the full-lock projection 37A are formed on the top wall of the female connector housing 73, and the lock hole 27 and the locking portion 29 are formed in the receptacle 72 of the joint housing 71. Here, no description is given on the functions of the respective elements to avoid the repetition since they are the same as in the foregoing embodiment.

What is claimed is:

1. A joint connector, comprising:

a plurality of terminal fittings, a connector housing provided with cavities configured to at least partly accommodate the terminal fittings, each cavity being formed with an elastic locking piece for elastically engaging and locking the corresponding female terminal fitting in the cavity, a joint housing configured for engagement with the connector housing, a joint terminal for shorting the plurality of terminal fittings to each other, the joint terminal being mounted to the joint housing, wherein insertion openings are formed in an outer wall of the connector housing in proximity to the elastic locking pieces, the insertion openings being configured to receive a jig for disengaging the respective elastic locking piece from the respective terminal fitting with the housings at least partly engaged, the housings being settable in a partly engaged state and in a substantially fully engaged state to connect the terminal fittings and the joint terminal, and the joint housing being formed with an insertion opening closing portion for leaving the insertion openings substantially open when the connector housing and the joint housing are in the partly engaged state and substantially closing the insertion openings when the connector housing and the joint housing are in the substantially fully engaged state.

2. A joint connector according to claim 1, wherein the insertion opening closing portion is provided with a deformation restricting portion which is configured for insertion into a space for permitting the elastic deformation of the elastic locking pieces, thereby restricting the elastic deformation of the elastic locking pieces.

3. A joint connector according to claim 1, wherein the joint housing (30; 71) also has a function of insufficient insertion detecting means for detecting the insufficient insertion of the terminal fittings (40) into the respective cavities (21).

4. A joint connector according to claim 3, wherein the insufficient insertion is detected by an engagement of the joint housing (30; 71) with the elastic locking piece (22) being deflected by the insufficiently inserted terminal fittings (40).

* * * * *